United States Patent [19]

Short

[11] 4,390,061

[45] Jun. 28, 1983

[54] APPARATUS FOR PRODUCTION OF LIQUID FROM WELLS

[76] Inventor: Charles Short, P.O. Box 629, Humble, Tex. 77338

[21] Appl. No.: 221,534

[22] Filed: Dec. 31, 1980

[51] Int. Cl.[3] ..... E21B 43/00; E21B 43/34; F04F 5/12; F04F 5/44

[52] U.S. Cl. ..... 166/53; 166/68; 166/75 R; 166/372; 417/108; 417/172

[58] Field of Search ..... 417/172, 55, 189, 188, 417/187; 166/372, 371, 64, 68, 53, 305, 105.6, 267, 75 R, 105; 55/201

[56] References Cited

U.S. PATENT DOCUMENTS

| | | | |
|---|---|---|---|
| 971,612 | 10/1910 | Holliday | 166/372 X |
| 1,754,945 | 4/1930 | Haskell | 166/372 |
| 1,861,843 | 6/1932 | Denman | 417/172 X |
| 2,029,457 | 2/1936 | Beardmore | 417/172 X |
| 2,845,125 | 7/1958 | Truman | 166/64 X |
| 2,999,560 | 9/1961 | Seefluth | 55/201 X |
| 3,025,911 | 3/1962 | Bergman | 166/305 R |
| 3,215,087 | 11/1965 | McLeod, Jr. | 417/55 |
| 3,344,587 | 10/1967 | Wakeman | 55/201 X |
| 3,551,074 | 12/1970 | Stout | 417/172 |
| 3,730,276 | 5/1973 | Land | 166/371 |

OTHER PUBLICATIONS

Uren, *Petroleum Production Engineering, Oil Field Exploitation,* 3rd Edition, McGraw-Hill Book Co., N.Y., 1953, pp. 217 to 228.

*World Oil,* "Venturi Jet Tool Unloads Gas Wells", Nov. 1979, p. 79.

*Primary Examiner*—Stephen J. Novosad

*Attorney, Agent, or Firm*—Gunn, Lee & Jackson

[57] ABSTRACT

Apparatus for production of liquid from wells such as petroleum wells includes well pipe that extends from the surface downwardly to the level of liquid standing within the well. A string of production tubing is positioned within the well pipe with the annulus between the production tubing and well pipe defining gas supply means that is interconnected with a source of compressed gas. At the lower portion of the production tubing is located aspirator means having a gas injection element defining a gas jet passage which is in communication with the gas supply annulus. The gas injection element is oriented to direct an upwardly flowing jet of pressurized gas which is directed into the lower restricted portion of a venturi that extends upwardly from the aspirator means into the production tubing. The aspirator means also defines a liquid flow passage that is in communication with liquid standing within the well. The liquid flow passage means and the gas injection jet have confluence within the restricted portion of the venturi whereby the jet of compressed gas aspirates the liquid and transports the liquid to the surface for ultimate handling. The production system is capable of being employed for production of single wells or production of plural wells in parallel or serial manner. The production system is also usable in conjunction with a lubricant system for injecting lubricant into the gas that is injected into the well and a chemical injector system for injecting any suitable chemical means into the upper discharge portion of the production tubing.

18 Claims, 12 Drawing Figures

APPARATUS FOR PRODUCTION OF LIQUID FROM WELLS

FIELD OF THE INVENTION

This invention relates generally to the production of liquid mediums such as oil, water or mixtures thereof from a subsurface production formation and, more particularly, is directed to a gas injection system for achieving production of such fluids from a subsurface formation that is intersected by one or more wells.

BACKGROUND OF THE INVENTION

Under circumstances where subsurface production formations have insufficient driving fluid for the purpose of forcing the production fluid to the surface of the earth, it is necessary to lift the production fluid to the surface by other suitable means. For example, pump systems are employed in many cases for the purpose of pumping the fluid to the surface and forcing it into flow lines or into other receiving means where it is subjected to preliminary treatment and then transmitted by means of pipelines and the like to other liquid handling facilities. Another method of producing liquid from wells of this nature involves a procedure generally known as gas-lift where a string of production fluid extending from the surface to the zone of interest is provided with a plurality of gas-lift valves positioned at spaced intervals along the length of the tubing. Gas is injected from an annulus between the tubing and well pipe through the gas-lift valves and into the tubing for the purpose of forcing liquid upwardly to the surface and ultimately into a flowline that is connected with the production tubing. Gas-lift systems for liquid production are quite expensive due to the cumulative expense of the number of gas-lift valves that are ordinarily necessary for each well. Moreover, each of the gas-lift valves must be preset for operation at differing pressures because of the vertical spacing thereof within the tubing string and because the valves must function in an interrelated manner to achieving lifting of liquid within the tubing string. It is desirable, therefore, to provide a system for gas-induced production of liquid from wells which achieves optimum production of the liquid without requiring exceptionally expensive equipment for the purpose of accomplishing such production.

Under certain circumstances, it may be desirable to inject a lubricant material into gas such as air being injected into a well for gas-lift induced liquid production. It is desirable, therefore, to provide apparatus for production of liquid from subsurface well formations which incorporates means for selective injection of lubricant material into the injected gas. It may also be desirable to provide for injection of chemical material into the discharge of a tubing string for the purpose of enhancing treatment of produced fluid as it flows toward handling or treatment facilities.

SUMMARY OF THE INVENTION

It is a primary feature of this invention, therefore, to provide novel apparatus for gas induced liquid production from wells wherein efficient production is achieved by means of a single aspirator system, thus effectively minimizing the expense required for installation of production equipment.

It is also a feature of this invention to provide novel apparatus for gas induced liquid production wherein a mechanism is employed for injection of gas into a tubing string and wherein the apparatus is provided with minimal moving parts and does not require specific pressure setting in order to achieve efficient operation.

It is an even further feature of this invention to provide novel apparatus for gas induced liquid production wherein lubricant material may be introduced into gas injected into the well in the event such is desirable.

It is another feature of this invention to provide novel apparatus for gas induced liquid production from wells wherein chemical material may be injected into liquid flowing from the well for the purpose of enhancing initial treatment of the liquid such as water separation, gas separation, etc.

Among the several features of this invention is contemplated the provision of novel apparatus for gas induced liquid production from wells and which is enabled to function for long periods of time without requiring servicing.

Other and further objects and novel features of the instant invention will be readily apparent from the following description taken in conjunction with the accompanying drawings. It is to be expressly understood that the drawings are for the purpose of illustration only and are not intended to define the limits of the invention, but rather to merely illustrate preferred embodiments and structures incorporating the features of this invention.

Briefly, the invention involves the placement of well pipe within a well that extends downwardly to the lowest level of liquid that will be standing within the well casing or well bore. Within the well pipe is positioned a string of production tubing that extends from the surface downwardly to the lower extremity of the well pipe. The production tubing may be provided with one or more intermediate check valves that allow upward flow of liquid and gas and are capable of seating to prevent downward flow within the production tubing. At the lower end of the production tubing is provided an aspirator system which includes a sand screen that extends through the lower end of the well pipe and is adapted to receive the standing liquid while at the same time screening out debris, sand and other particulate that might otherwise interfere with efficient production operation.

The aspirator mechanism includes a gas injection element internally thereof which is in communication with the annulus that is defined between the production tubing and the well pipe. Gas is injected into the annulus from a source of compressed gas such as an air compressor and this compressed gas enters the gas injection element through an injection opening that communicates with the annulus. The gas injection element defines an upwardly directed jet passage that causes a high velocity jet of compressed gas to be directed upwardly into the production tubing. The aspirator housing also defines a liquid flow path extending upwardly from the sand screen and having confluence with the upwardly directed jet of gas in the restricted throat of a venturi that is in communication with the production liquid flowing upwardly through the liquid flow path. The high velocity jet of gas causes aspiration of the liquid in the throat of the venturi, thus lightening the liquid and enabling it to be transported by the gas upwardly through the production tubing and into a flow line that conducts the liquid to apparatus for further treatment or storage.

Immediately below the gas injection element or upstream from the standpoint of liquid flow, there is provided a liquid actuated check valve that is readily opened by upwardly directed flow but readily closes to prevent downwardly directed flow. This check valve may conveniently take the form of a guided check valve that is supported within the aspirator mechanism and adapted for linear movement or may take the form of a simple ball type standing valve.

The aspirator type liquid production mechanism may conveniently be employed for production of single wells, production of plural wells in serial manner or production of plural wells in parallel manner. Additionally, the aspirator type liquid production mechanism may be utilized in conjunction with lubricant injection apparatus for injection of lubricant into the compressed gas entering the annulus or chemical injector apparatus for injection of chemical materials either into the production tubing or into the liquid as it flows from the production tubing. This chemical material may, for example, subject the produced liquid to preliminary treatment for the purpose of enhancing efficient separation as it flows through a separator system and into a storage or pipeline transportation system. Additionally, the production tubing may be provided with one or more standing valves intermediate the extremities thereof that provide for controlled handling of production liquid that exits the aspirator mechanism.

BRIEF DESCRIPTION OF THE DRAWINGS

In order that the manner in which the above-recited advantages and features of the invention are attained, as well as others, which will become apparent, can be understood in detail, more particular description of the invention, briefly summarized above, may be had by reference to the specific embodiments thereof that are illustrated in the appended drawings, which drawings form a part of this specification. It is to be understood, however, that the appended drawings illustrate only typical embodiments of the invention and are therefore not to be considered limiting of its scope, for the invention may admit to other equally effective embodiments.

In the Drawings.

DETAILED DESCRIPTION OF PREFERRED EMBODIMENT

Figure 1:
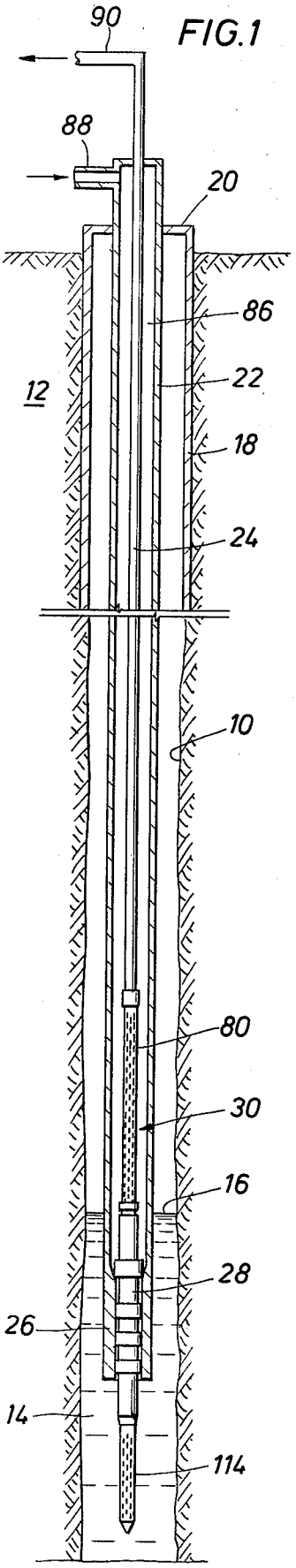
FIG. 1 is a sectional view of an aspirator type liquid production system for wells which is constructed in accordance with the present invention and which shows lubricant and chemical injector apparatus provided in connection therewith.
Figure 2A:
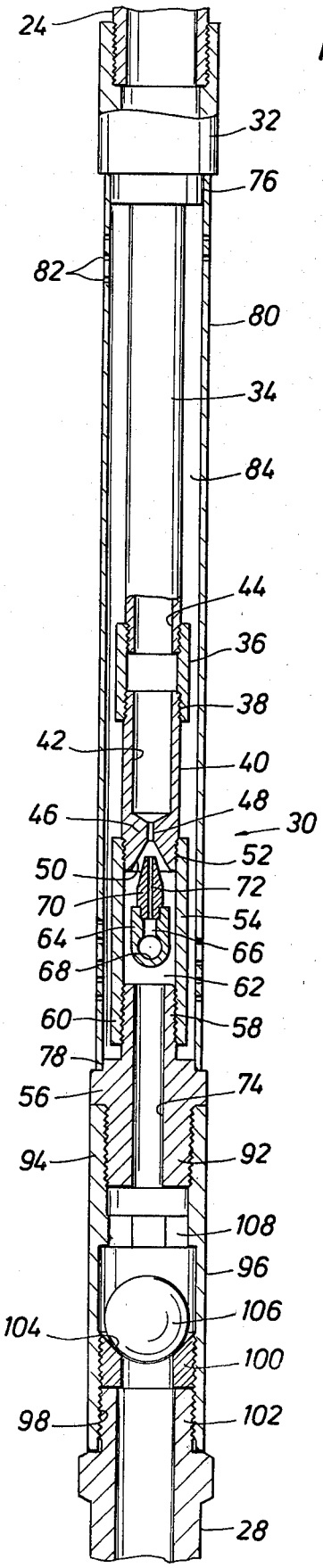
FIG. 2 is a partial sectional view of the aspirator type liquid production mechanism of FIG. 1, illustrating connection of the aspirator mechanism to the lower extremity of the production tubing string and showing upwardly directed flow of gas and liquid by means of flow arrows.
Figure 2B:
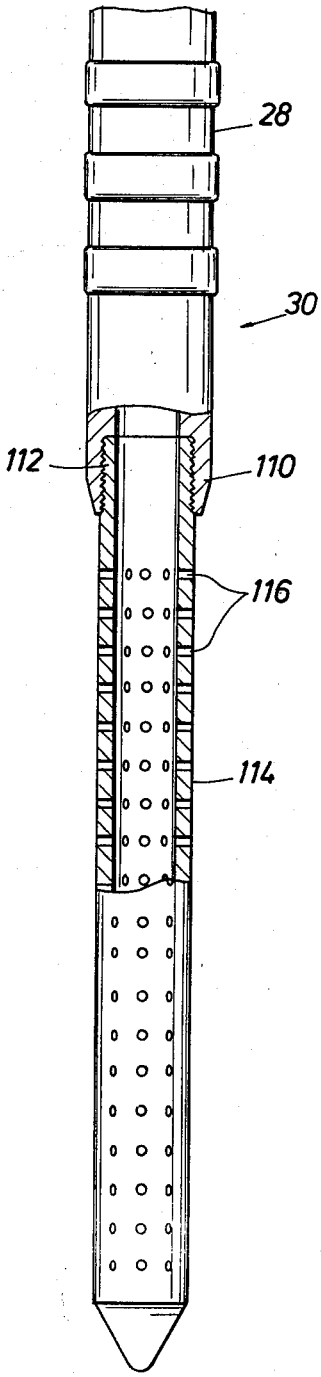

Referring now to the drawings and first to FIG. 1, there is shown a well bore 10 that extends downwardly through earth formations 12 and has production liquid 14 standing therein to a level 16. The well bore 10 is typically at least partially lined with well casing 18, the upper portion 20 of which defines a wellhead or hanger assembly that provides support for well pipe 22 and production tubing 24 that extend into the well. At the lower extremity of the well pipe 22 is provided a landing nipple 26 within which is received a locking mandrel 28 that is an integral portion of an aspirator mechanism illustrated generally at 30. The aspirator mechanism 30, which is shown in detail in FIGS. 2A and 2B, is secured by an internally threaded connector or collar 32 to the lower externally threaded extremity of the production tubing 24. A support tube 34 extends downwardly from the connector 32 and is connected by means of a collar 36 to the upper externally threaded extremity 38 of a venturi member 40. The venturi member 40 defines an upper passage section 42 of essentially the same dimension as the flow passage 44 defined by the support tube 34. The venturi member is also formed to define an internally restricted lower portion 46 forming a restricted passage 48 that is in communication with a generally conical venturi entry receptacle 50 that is defined by the lower extremity of the venturi member. The venturi member is also formed to define an externally threaded portion 52 that is received within the internally threaded upper extremity of a venturi housing tube 54. A connector adaptor 56 is formed to define an upper externally threaded portion 58 that is received by an internally threaded lower portion 60 of the venturi housing tube 54 and cooperates with the venturi element 40 and venturi housing to define a venturi chamber 62. A gas injection element 64 is positioned within the venturi chamber 62 with at least a portion thereof interconnected with the wall structure defining the venturi housing tube 54. The gas injection element defines an injection passage 66 having at least one opening or port 68 that opens through the wall structure of the venturi housing tube 54. Thus, compressed gas such as air is enabled to pass through the venturi housing tube 54 by means of the port 68 and enters the gas injection passage 66. A gas jet element 70 is interconnected with the gas injection element 64 and defines a restricted jet passage 72 that terminates at a jet opening positioned within the venturi entry receptacle 50 and oriented to direct a jet of high velocity gas into the restricted passage 48 of the venturi member.

That portion of the venturi chamber 62 that surrounds the gas injection element 64 forms a liquid flow passage that is in communication with a passage 74 defined within the connector adaptor 56. Liquid, therefore, is enabled to flow upwardly through the passage 74 of the connector adaptor into the venturi chamber 62 and flows into an annulus defined about the jet element 70. The liquid and injected gas have confluence at the jet outlet of the restricted jet passage 72 and thus a high velocity jet of gas directed through the restricted venturi passage 48 causes aspiration of the liquid in the restricted venturi passage. The aspirated liquid flows into the outlet passage 42 of the venturi and thence upwardly through the passage 44 of the support tube and into the production tubing 24.

The connector element 32 and connector adaptor 56 are each formed to define reduced diameter portions 76 and 78, respectively, that receive upper and lower extremities of a gas screen element 80. The gas screen element defines a multitude of screen openings 82 through which gas flows into an annulus 84 that is defined between the screen and the internal structural portions of the aspirator mechanism. The port 68 of the gas injection element 64 is in communication with the annulus 84 and thus receives the screened injected gas from the annulus for purposes of liquid aspiration. The screen element 80 is provided for the purpose of preventing any large debris, such as line scale, sand, etc., from entering the annulus 84 and thus allows the restricted jet passage 72 to remain unobstructed at all times.

Compressed gas is introduced into an annulus that is defined between the well pipe 22 and the production tubing 24 by means of an injection conduit 88. The compressed gaseous medium, which is typically air or any other suitable gas, is provided from a suitable source, such as a compressor. Gas forced into the annulus 86 therefore travels downwardly through the annulus 86 and passes through the screen 80 into the annulus 84 of the aspirator mechanism 30 and then enters the port 68 for aspiration of liquid in the restricted passage 48 of the venturi. The aspirated liquid and gas composition then flows upwardly through the tubing string and enters a flow line 90 that is interconnected with the tubing string at the wellhead. The flow line 90 transports the produced liquid and gas to appropriate systems for separation and further handling in the manner described hereinbelow.

With reference now to the lower portion of FIG. 2A and FIG. 2B, the connection adaptor 56 is formed to define an externally threaded lower portion 92 that is connected to the internally threaded upper portion 94 of a valve housing 96. The tubular valve housing defines an internally threaded section 98 of considerable length which receives an externally threaded valve seat element 100 and also receives the upper externally threaded portion 102 of the locking mandrel 28. The valve seat element 100 defines a tapered annular valve seat 104 which is adapted to receive a standing valve ball 106 in sealing engagement therewith. The valve ball 106 readily moves upwardly to allow upward flow of liquid and readily becomes seated to prevent downwardly directed flow of the liquid. Thus, the valve mechanism represents a unidirectional check valve allowing only upwardly directed liquid flow. An internal spider 108 is positioned within the tubular valve housing 96 and functions to prevent the valve ball 106 from sealing in an upwardly direction and preventing upwardly directed flow.

As shown in FIG. 2B, the locking mandrel 28 is formed to define an internally threaded lower extremity 110 which receives the internally threaded upper portion 112 of a sand screen 114. The sand screen 114 defines a multitude of screen openings 116 of particular size to restrict entry of particulate into the flow path that might obstruct or otherwise interfere which flow through the restricted passage 48 of the venturi 40.

Figure 3:
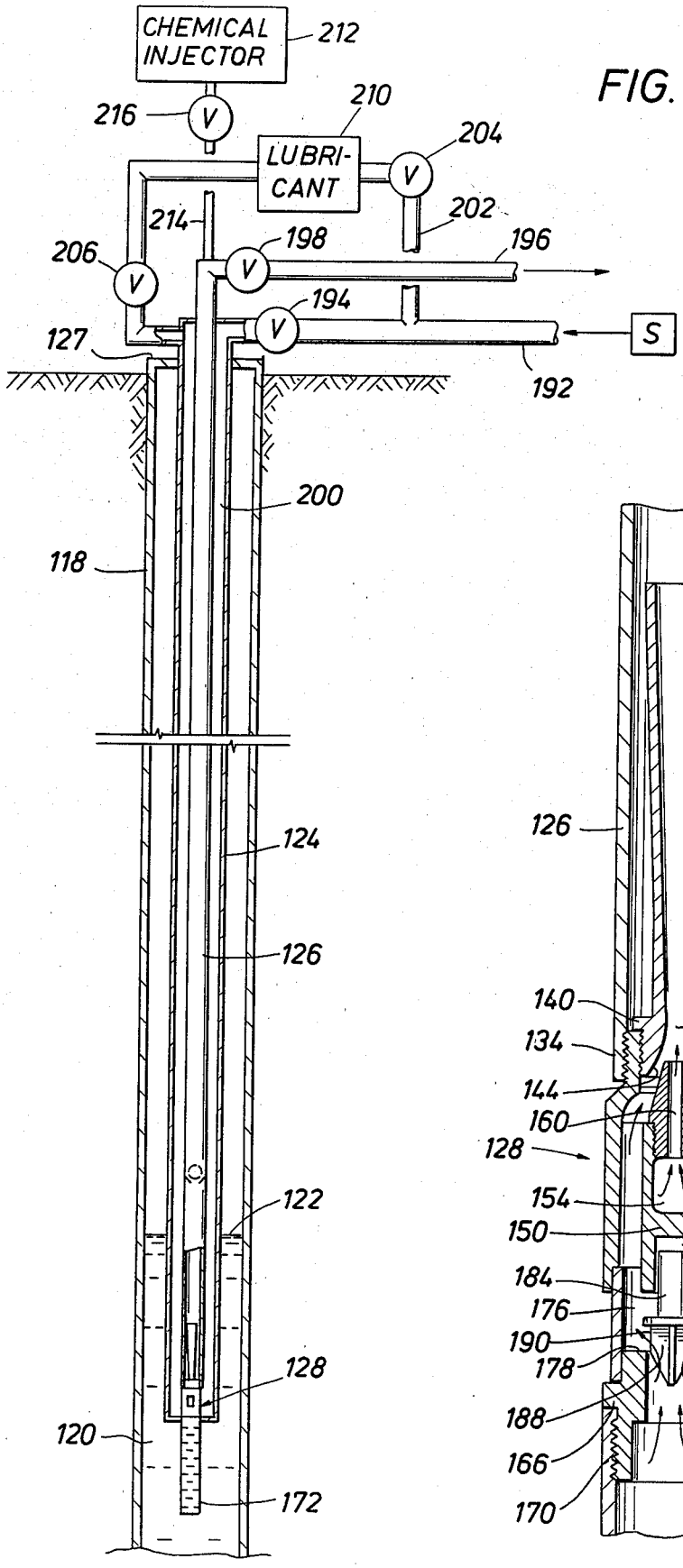
FIG. 3 is a sectional view of a well that is provided with aspirator type liquid production apparatus representing an alternative embodiment of the present invention.
Figure 4:
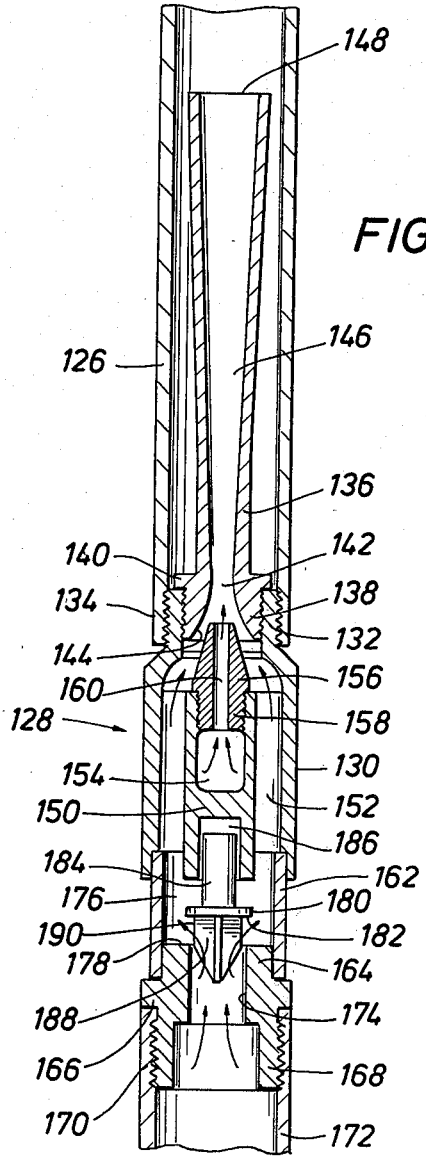
FIG. 4A is a partial sectional view of the aspirator type liquid production apparatus of FIG. 3 illustrating the internal structure thereof in detail.
FIG. 4B is a partial sectional view the lower portion of the apparatus of FIG. 4A.

Referring now to FIGS. 3 and 4, an alternative embodiment of the invention is disclosed which functions in the same manner as illustrated in FIGS. 1, 2A and 2B, and which illustrates the use of lubricant and chemical injector means in conjunction with gas energized aspiration and production of liquid from a well. As shown in FIG. 1, well casing 118 extends downwardly through the earth formation and intersects a production zone. Production liquid, such as oil or oil and water indicated at 120, stands within the well to a level 122. A well pipe 124 extends from a wellhead 126 to a position below the level 122 of liquid standing within the well. A string of production tubing 126 extends downwardly through the well pipe 124 and is interconnected with an aspirator mechanism illustrated generally at 128 and shown in detail in FIG. 4. The aspirator mechanism incorporates an aspirator housing of generally tubular form which is provided with an internally and externally threaded upper extremity 132 which is received in threaded interconnection with the internally threaded lower extremity 134 of the production tubing 126. A venturi element 136 defines an externally threaded lower portion 138 which is received within the internal threads defined by the upper portion 132 of the aspirator housing 130. The venturi element defines an annular shoulder flange 140 that engages the upper extremity of the aspirator housing when fully threaded engagement is established therebetween. The lower portion of the venturi element defines a restricted throat 142 communicating with a venturi entry receptacle 144 and an upwardly diverging venturi outlet passage 146. The upper portion of the venturi 136, defining the venturi outlet passage 146, extends upwardly into the production tubing 126 and terminates at a venturi outlet opening 148.

The aspirator housing 130 is provided with an internal gas injection element 150 that cooperates with the tubular external portion of the housing to define liquid passage means 152 through which liquid is enabled to flow upwardly toward the venturi element 136. The gas injection element is interconnected with the tubular housing 130 and a gas injection port 154 is formed in the wall structure of the housing 130 and thus provides for entry of pressurized gas through the housing and into a gas injection passage defined within the gas injection element. A jet nozzle 156 is provided with an externally threaded lower portion 158 that is received in threaded engagement with the internally threaded upper portion of the gas injection element 150. The jet nozzle 156 defines a jet passage 160 that is oriented to register with the center line of the restricted throat 142 of the venturi element 136. The upper extremity of the jet nozzle 156 is positioned within the entry receptacle 144 of the venturi and forms an annulus with the venturi entry receptacle that allows liquid to flow about the jet nozzle and enter the venturi throat immediately after confluence with the jet of gas exiting the restricted jet passage 160. The high velocity of gas from the jet nozzle causes aspiration of the liquid in the throat 142 of the venturi and the aspirated liquid then is caused to flow upwardly at relatively high velocity through the production tubing 126.

At the lower portion of the aspirator housing 130 is connected a tubular valve housing 162 which is secured at the lower extremity thereof to a reduced diameter portion 164 of a connection adaptor 166. The connection adaptor is formed to define an externally threaded lower portion 168 which is connected to the internally threaded upper extremity 170 of a sand screen 172. The connector adaptor 166 is also formed to define a liquid flow passage 174 which is in communication with the sand screen 172 and thus allows upwardly flow of liquid from the sand screen into a valve chamber 176 that is formed between the connection adaptor and the lower extremity of the aspirator housing 130. The upper extremity of the connection adaptor 166 defines an annular valve seat surface 178. A valve element 180 is movably positioned within the valve chamber 176 and defines an annular sealing surface 182 that is adapted for sealing engagement with the seat surface 178. The upper portion of the valve element 180 defines an elongated guide stem 184 that is received within a guide receptacle 186 formed in the lower extremity of the gas injection element 150. The valve element 180 is adapted for linear movement within the valve chamber under the influence of liquid flowing upwardly from the sand screen and through the flow passage 174 of the connection adaptor. The lower portion of the valve element 180 is defined by a plurality of plates 188 that radiate outwardly from the axial center-line of the valve element. The radiating plates are tapered at the lower extremities thereof so as to permit entry of the lower extremity of the valve element into the passage 174. Further, each of the radiating plates 188 defines an outer guide surface that establishes a guiding relation with respect to the cylindrical surface defining passage 174, thus ensuring that the valve element 180 will be maintained in properly oriented relation with respect to the center line of the flow passage 174. Thus, the valve element is guided during both upward and downward movement and is maintained in proper relation with the gas injection element and connection adaptor during such movement. The valve element 180 functions as a check valve to allow upwardly directed flow of liquid from the sand screen into the aspirator housing, but prevents downwardly directed flow of liquid.

Either of the aspirator mechanisms illustrated in FIGS. 1, 2A and 2B or FIGS. 3 and 4 may be utilized in conjunction with chemical and/or lubricant injection apparatus. As shown in the upper portion of FIG. 3, gas from a suitable source S of compressed gas, such as an air compressor, for example, is transported by an injection line 192 which is interconnected with the well pipe 124 and is controlled by means of a gas injection valve 194. A discharge flow line 196 is interconnected with the upper portion of the production tubing 126 and is controlled by means of a flow line control valve 198 to control discharge of production fluid from the well. In the event it is desirable to introduce a lubricant material into the gas being injected into the annulus 200 between the well pipe and production tubing, a lubricant bypass conduit circuit is provided as shown at 202. The lubricant bypass circuit is controlled by lubricant valves 204 and 206 that are positioned on opposed sides of lubricant injection apparatus 210 which is interconnected within the bypass conduit 202. When gas lubrication is desired, the injection valve 194 will be closed while valves 204 and 206 will be open. The flow of injected gas then flows through the bypass circuit, thereby causing lubricant material from lubricant injection apparatus 210 to flow along with the gas into the annulus 200.

In the event it is desired to inject a chemical medium into the production fluid flowing from the production tubing string 126 into the discharge flow line 196, suitable chemical injector apparatus is provided as shown schematically at 212 and is interconnected with a chemical injection conduit 214 under the control of a chemical injection valve 216. The chemical medium introduced into the discharging production fluid may be of a character that enhances initial treatment of the production fluid for the purpose of achieving efficient separation of gas, water and particulate from oil or may take any other suitable form.

Figure 5:
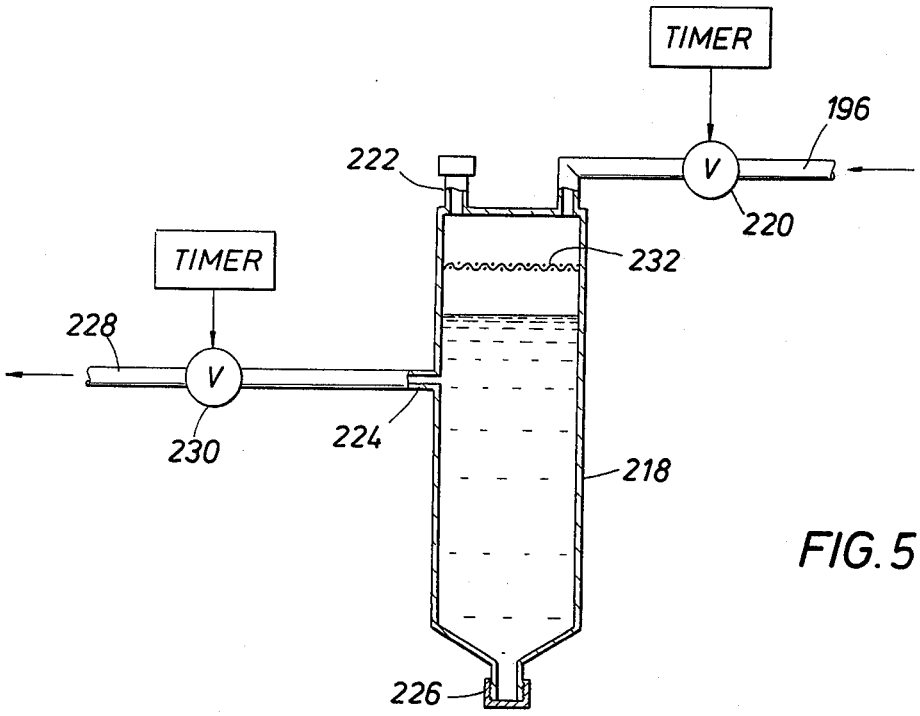
FIG. 5 is a partial sectional view of a separator vessel for attachment to the discharge line of the well production mechanism of FIG. 1.

Referring now to FIG. 5, the aspirator type liquid production system set forth in FIGS. 1–4 may be utilized in conjunction with a separator system, as shown. The discharge flow line 196 may be connected to a separator vessel 218 and fluid flowing into the vessel may be controlled by a timer valve 220. The separator vessel 218 will be provided with an upper gas outlet 222 and intermediate oil outlet 224 and a lower water outlet 226. The oil outlet will be interconnected with a discharge line 228 and flow through the discharge line will be controlled by means of a timer controlled valve 230. Timer controlled valves 220 and 230 will be preset at a timing sequence determined by the flow characteristics of the well or wells being produced. For the purpose of screening out large debris that might enter the separation vessel from the flow line 196, a screen element 232 may be provided within the upper portion of the vessel.

Figure 6:
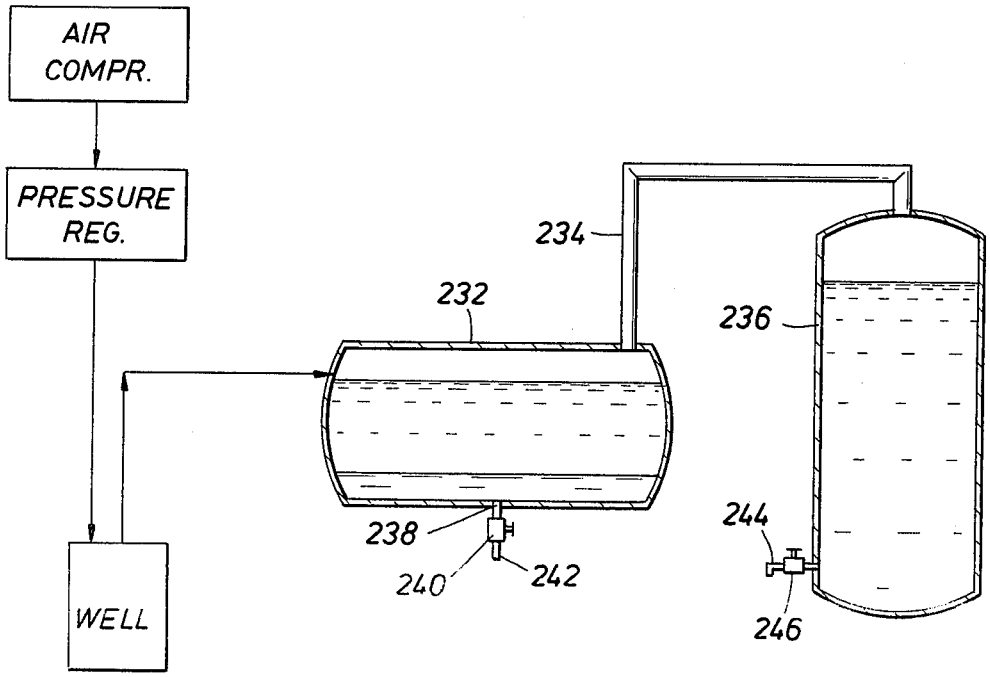
FIG. 6 is a sectional view representing an alternative embodiment of the present invention and showing a separator system that is adapted for separation of fluid produced by the well of FIG. 1.

FIG. 6 represents another separator system that may be employed in conjunction with the aspirator type production system of the present invention. As illustrated schematically, air from an air compressor or other suitable source flows through a pressure regulator and enters the well at controlled pressure. The discharge of the well will typically contain oil, water and air and perhaps some small percentage of natural gas that is present along with the oil. The discharge of the well is then directed to a separator vessel 232 having an oil discharge conduit 234 that is interconnected with a storage vessel 236. At the lower portion of the separator vessel 232 is provided a water drain 238 that is controlled by means of a drain valve 240. The valve 240 may be automatically energized in relation to accumulation of water within the vessel 232, thereby periodically draining water into a discharge conduit 242 for ultimate disposal. Oil from the separator chamber 232 will flow through conduit 234 into the storage vessel 236. Periodically, oil from the storage vessel will be drawn off by means of a discharge conduit 244 under control of a discharge valve 246.

Figure 7:
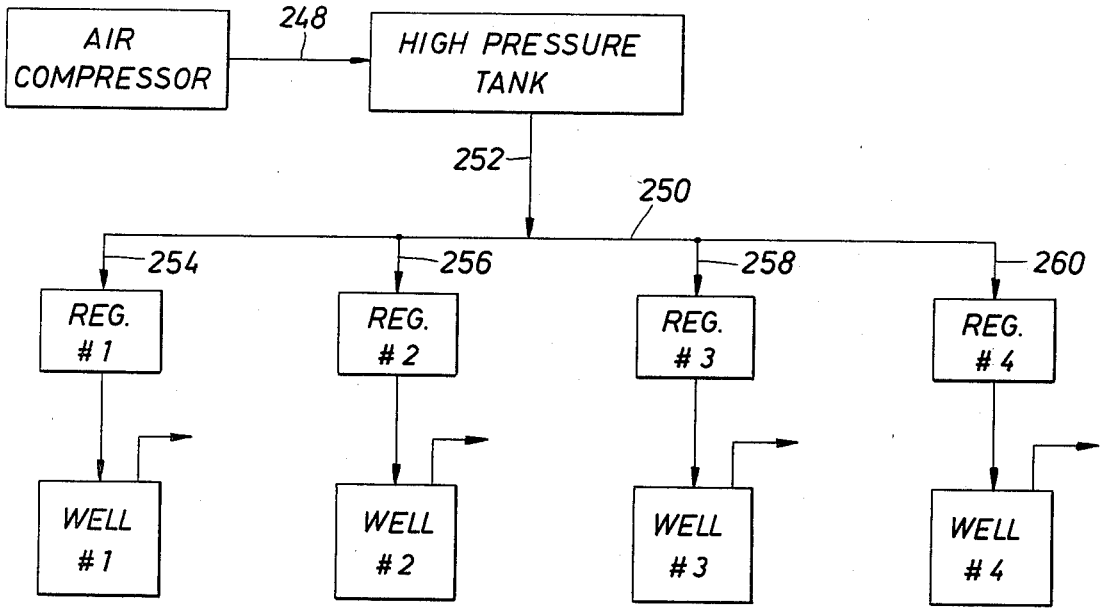
FIG. 7 is a schematic illustration showing parallel production of a plurality of wells employing the aspirator type production system of FIG. 1 by means of a single controlled source of compressed gas.
Figure 8:
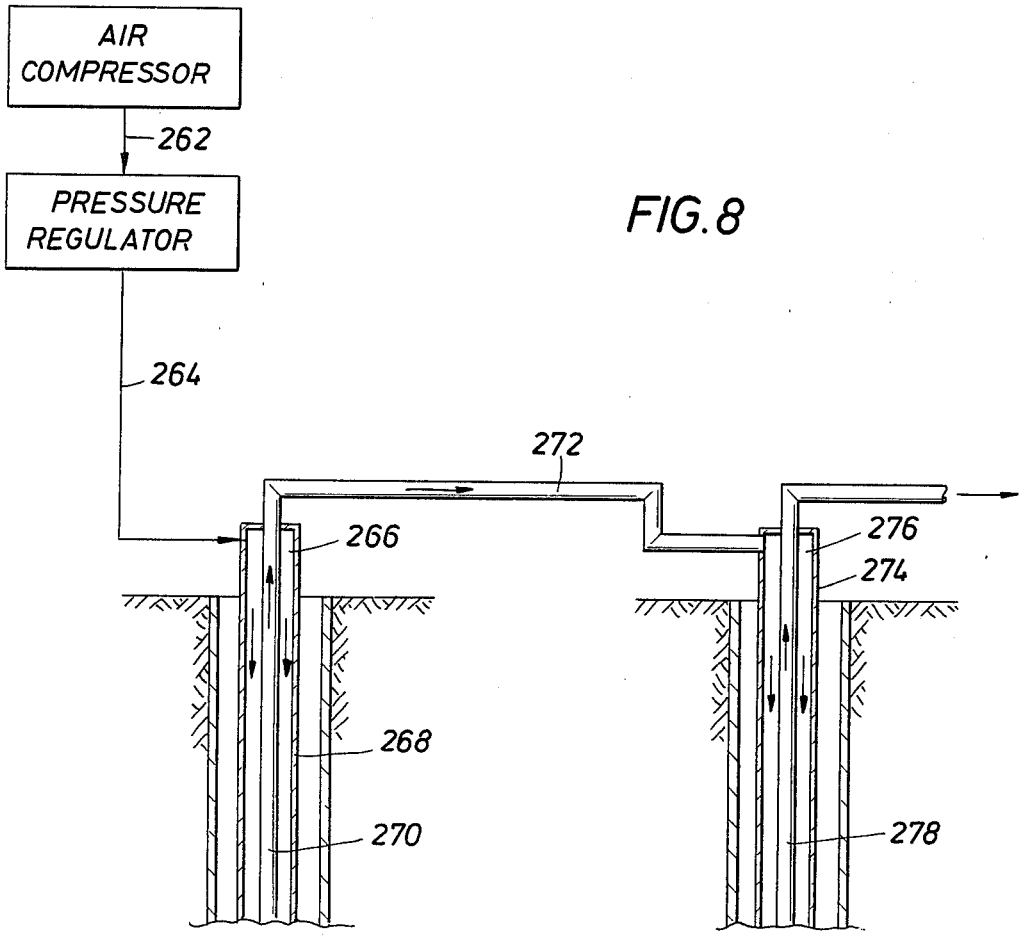
FIG. 8 is a partial sectional view of wells employing aspirator type production systems such as shown in FIG. 1 with gas induced production being accomplished in serial manner from a single regulated source of compressed gas.

Referring now to FIGS. 7 and 8, it is intended that these features schematically represent parallel and serial systems for simultaneous production of a plurality of wells utilizing the aspirator influenced production system of the present invention. As shown in FIG. 7, air or other compressed gaseous medium is provided by a compressor and the compressed air or gas is transferred by a conduit 248 to a high pressure tank for storage and accumulation. A manifold conduit 250 is interconnected with a discharge conduit 252 of the high pressure tank and provides a supply of compressed air that is conducted at high pressure to a plurality of distribution conduits 254–260 that are connected respectively to regulators 1–4, thus providing regulated injection of gas into each of the wells 1–4 in the manner described hereinabove in connection with FIGS. 1–4. Each of the regulators 1–4 may be preset at differing pressures depending upon the pressure characteristics desired for optimum production of each of the wells.

It may also be desired to produce a plurality of wells in serial manner. As shown in FIG. 8, an air or gas compressor is provided having a supply conduit 262 connected with a pressure regulator to provide air at regulated pressure for introduction through an injector conduit 264 into the annulus 266 between a well pipe 268 and production tubing 270 of a first well. The discharge conduit or flow line 272 extending from the first well is interconnected with the well pipe 274 of the second well, thus injecting the discharge of the first well into the annulus 276 defined between the well pipe 274 and the production tubing 278 of the second well. A number of wells may be thus interconnected in serial manner to achieve efficient production through utilization of a single source of compressed gas.

Figure 9:
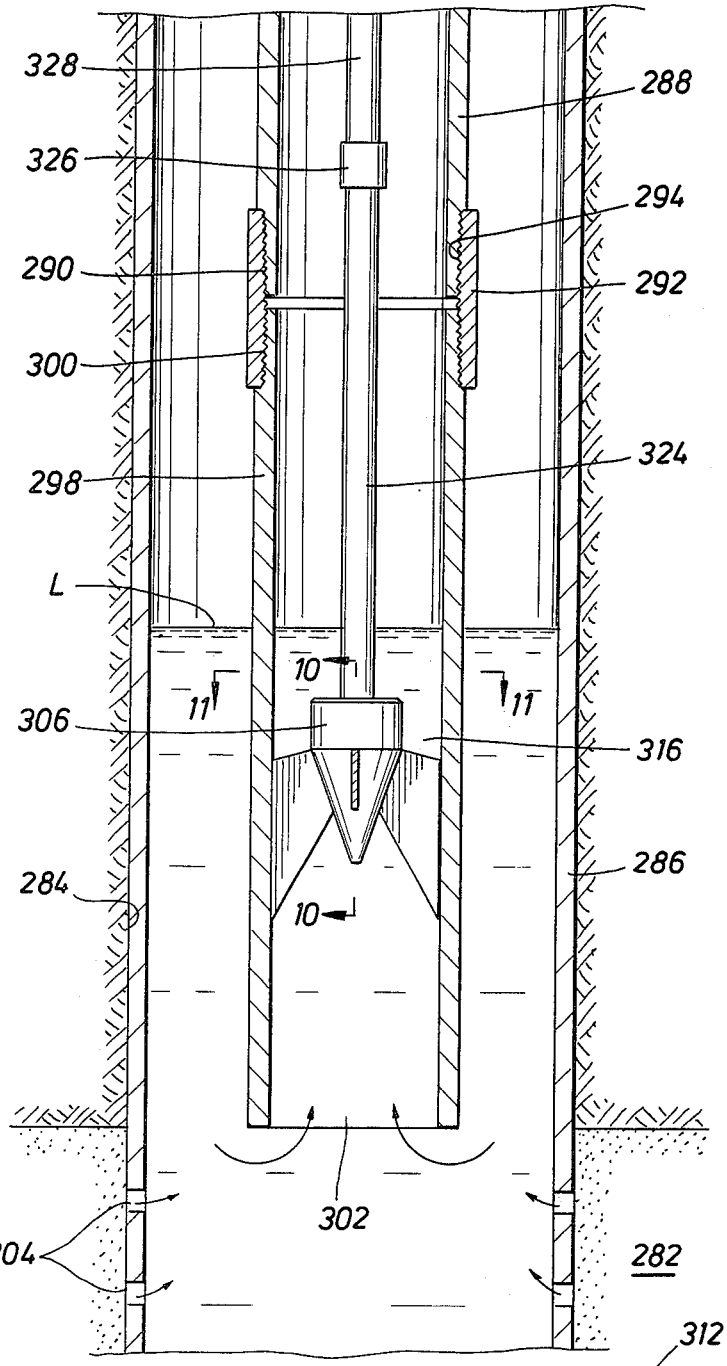
FIG. 9 is a partial sectional view of a well, illustrating production of the well by means of apparatus representing an alternative embodiment of the present invention.

Under certain circumstances, it may be desirable to achieve gas induced production of oil from oil wells without requiring the oil and other liquid produced to be caused to flow through a restricted orifice. Under such circumstances, the present invention may conveniently take the form illustrated in FIGS. 9, 10 and 11 which represent an alternative embodiment of this invention. With reference particularly to FIG. 9, a subsurface formation is shown at 280 having a production formation 282 from which liquid materials such as oil and mixtures of oil and water are to be produced. A well bore 284 extends downwardly through the formation 280 and intersects the oil bearing formation 282. The well bore is lined by means of a casing 286 which, for purposes of ready understanding, may be a small casing such as a pipe of 2" inside diameter, such as might be utilized in producing relatively shallow wells. A production conduit 288 such as a string of pipe having a 1" inside diameter extends downwardly through the casing 286 to a point below the level L of liquid standing within the casing. At the lower extremity of the string of production tubing 288, may be provided external threads 290 which are received within an internally threaded collar 292 having upper and lower internal threaded portions 294 and 296.

Aspirator means for accomplishing gas induced production of fluid from the well comprises an aspirator body 298 that defines an externally threaded upper extremity 300 which is received in threaded engagement within the lower internally threaded portion 296 of the collar 292. The aspirator body is thus supported within the casing 286 by means of the string of production tubing 288. The aspirator body 298 is of generally cylindrical configuration, being of approximately the same diameter as the production tubing 288. In practice, it may be practical to form the aspirator body from a section of the same type of tubing that forms the string of production tubing. The lower extremity of the aspirator body defines an opening 302 through which oil and other liquid material flow after entering the casing 286 by way of the casing perforations 304.

Figure 10:
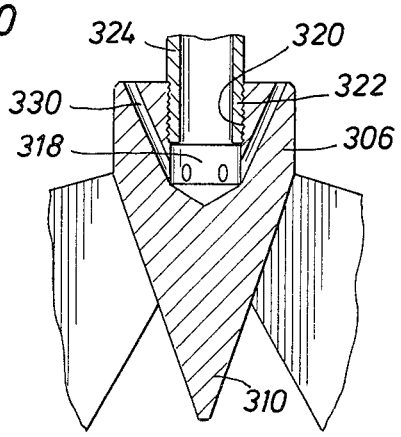
FIG. 10 is a sectional view taken along line 10—10 of FIG. 9.
Figure 11:
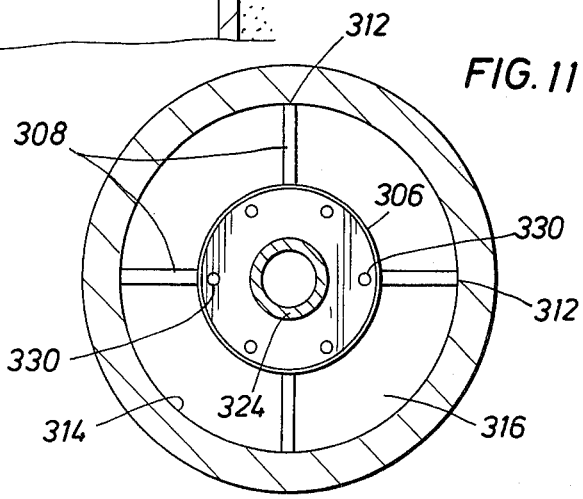
FIG. 11 is a sectional view taken along lines 11—11 of FIG. 9.

As shown in detail in FIGS. 10 and 11, the aspirator mechanism includes an aspirator element 306 having a positioning spider connected therewith which is defined by a plurality of vane elements 308. The vane elements are affixed to a downwardly and inwardly tapered, generally conical portion 310 of the aspirator element and extend radially therefrom. The vane elements define outer positioning surfaces 312 that contact the inner wall surface 314 of the aspirator body and establish centralized positioning of the aspirator element 306 within the aspirator body. The larger generally cylindrial upper portion of the aspirator element 306 cooperates with the lower conical portion 310 thereof to define a generally annular flow passage 316 through which fluid is enabled to flow as it is produced upwardly through the production tubing 288. The flow passage 316 is segmented by the radiating vane elements 308. The vane elements 308 do not provide any material restriction to the upward flow of liquid that passes through the segmented annulus 316 defined between the aspirator element 306 and the inner wall surface 314 of the aspirator housing.

With reference now to FIG. 10, the aspirator element 306 is shown to define a gas distribution receptacle 318 having an internally threaded portion 320 that receives the lower externally threaded extremity 322 of a gas supply conduit 324. The gas supply conduit is connected by means of a coupling 326 to a gas supply line 328 that extends upwardly through the production tubing 288 to the surface and is in communication with a supply of pressurized gas, not shown. A plurality of aspirator passages 330 are formed in the aspirator element 306 and are inclined upwardly and outwardly in such manner as to direct jets of gas in upwardly and outwardly diverting direction against the internal cylindrical surface 331 formed within the aspirator body 288. These upwardly and outwardly directed jets of pressurized gas cause liquid present within the aspirator body to be transported upwardly within the production tubing, thereby causing oil and other liquid materials to be produced at the upper extremity of the well. The passage 330 terminates at a plurality of outlet openings at the planar upper surface 332 and are arranged in a generally circular pattern for efficient gas distribution.

It has been determined that a as supply conduit having an inside diameter in the order of ¼" is sufficient for efficient production of liquid within a production conduit having an inside diameter of approximately 1". The aspirator apparatus of FIGS. 9–11 has also been determined to be efficient in the production of oil and combinations of oil and water from relatively shallow oil wells.

While the foregoing is directed to the preferred embodiments of the present invention, other and further embodiments of the invention may be devised without departing from the basic concept thereof, and the scope thereof is determined by the claims which follow.

I claim:

1. Apparatus for production of liquid from a subsurface formation intersected by a well bore said apparatus comprising:

a string of production tubing extending into said well bore and into liquid standing within said well bore;

aspirator means being interconnected with said production tubing and being positioned below the level of liquid standing within said well, said aspirator means defining an aspirator housing secured to said production tubing, said aspirator housing defining a gas injection section in communication with said gas supply means, said gas injection section defining a liquid flow path in communication with liquid standing within said well and a gas flow path, said gas injection further defining a valve retainer;

a valve housing being interconnected with said aspirator housing and defining a valve seat;

a valve element being movably received by said valve retainer and being movable to open and closed positions responsive to conditions of liquid flow within said liquid path, said valve element being at least partially receivable within said valve seat, said valve retainer and valve housing providing guiding support for said valve element;

an upwardly directed nozzle being defined by said aspirator means and defining a restricted gas jet passage being the terminal portion of said gas flow path;

gas supply means communicating a pressurized gaseous medium from a gas supply source to said gas flow path; and venturi means being defined within said aspirator means and being in communication with said liquid flow path, said gas jet passage and said liquid flow passage means having confluence with said venturi means and terminating within said venturi means, said gas jet passage directing a jet of compressed gas upwardly through said venturi means and causing liquid within said liquid flow path to flow upwardly into said venturi means and become aspirated and thus transported upwardly through said production tubing for production at the surface.

2. Apparatus as recited in claim 1, wherein said aspirator means includes:

check valve means being interconnected within said liquid flow path upstream of said venturi means and being opened by upwardly flowing liquid, said check valve means being closed by the hydrostatic pressure of said liquid upon cessation of liquid flow within said input flow path.

3. Apparatus as recited in claim 2, including:

tubing check valve means being interconnected within said production tubing downstream of said aspirator means, said tubing check valve means being opened by upwardly flowing gas and liquid and being closed by gravity upon cessation of upward flow within said production tubing.

4. Apparatus as recited in claim 2, including:

screen means defining inlet opening means for said liquid flow path, liquid from said well bore passing through said screen means and entering said liquid flow path, said screen means preventing certain debris from entering said liquid flow path.

5. Apparatus as recited in claim 1, wherein said means communicating said gaseous medium comprises:

a well pipe extending from the surface into liquid standing within said well, said production tubing extending through said well pipe and cooperating therewith to define an annulus, said annulus receiving said pressurized gaseous medium at the upper portion thereof and communicating with said gas flow path at the lower portion thereof.

6. Apparatus as recited in claim 1, wherein said aspirator means comprises:

a gas injection element being positioned within said liquid flow path, said gas flow path being defined by said gas injection element, said gas injection element defining an opening for said gas flow path in communication with said means communicating said pressurized gaseous medium from said gas supply source.

7. Apparatus as recited in claim 1, including:

jet nozzle means extending from said gas injection section and defining said gas jet passage.

8. Apparatus as recited in claim 1, wherein said valve retainer comprises:

a guide receptacle being formed in the lower portion of said gas injection section; and a guide stem being formed on the upper portion of said valve element and being receivable in guided relation within said guide receptacle.

9. Apparatus as recited in claim 8, wherein:

said valve housing defining a valve flow passage intersecting said valve seat; and said valve element defining a lower guide portion being received in guided relation within said valve flow passage.

10. Apparatus as recited in claim 1, wherein said venturi means comprises:

a venturi element being supported by the upper portion of said aspirator housing and extending upwardly into said tubing.

11. Apparatus as recited in claim 1, including:

means for injecting lubricant into said pressurized gaseous medium.

12. Apparatus as recited in claim 1, including:

means for injection a chemical medium into liquid and gas flowing through said tubing from said well.

13. Apparatus as recited in claim 1, including separator means receiving the flow of fluid from said tubing and separating water, debris and gas from oil, said separator means comprising:

a separator vessel having an inlet in controlled communication with said tubing and having a gas outlet, an oil outlet and a water and sediment outlet; and timer controlled valve means controlling opening and closing of said inlet and said oil outlet in relation to the volume of fluid produced from said well.

14. Apparatus as recited in claim 13, including screen means within the inlet portion of said separator and screening debris from fluid flowing into said separator from said inlet.

15. Apparatus as recited in claim 14, wherein said inlet and said gas outlets are located at the upper portion of said separator;

said oil outlet is located intermediate the upper and lower ends of said separator; and said water and sediment drain is located at the lower portion of said separator.

16. Apparatus as recited in claim 1, including separator and oil storage means comprising:

a separator vessel having an inlet in communication with said tubing and defining an oil outlet and a water outlet;

an oil storage vessel having an inlet interconnected with said oil outlet of said separator vessel, said oil storage vessel having an oil outlet.

17. Apparatus as recited in claim 1, wherein a plurality of wells are produced, said apparatus including:

gas compressing means for compressing said gaseous medium;

gas supply means receiving compressed gas from said gas compressing means;

gas receiving means being provided for each of said plurality of wells; and gas distribution means being connected in parallel relation to said gas supply means and said gas receiving means of each of said wells.

18. Apparatus as recited in claim 17, wherein said gas receiving means comprises:

pressure regulator means for each of said wells and being interconnected in receiving relation with said gas. distribution means.

* * * * *